United States Patent [19]

Miller

[11] Patent Number: 4,877,487

[45] **Date of Patent: * Oct. 31, 1989**

[54] BELT AND DRUM-TYPE PRESS WITH SUPPLEMENTAL NIP LOADING MEANS

[76] Inventor: Ray R. Miller, 8816 Warren Dr. N.W., Gig Harbor, Wash. 98335

[ * ] Notice: The portion of the term of this patent subsequent to Dec. 1, 2004 has been disclaimed.

[21] Appl. No.: 214,594

[22] Filed: Jul. 1, 1988

Related U.S. Application Data

[63] Continuation-in-part of Ser. No. 94,137, Sep. 8, 1987, Pat. No. 4,758,310, which is a continuation-in-part of Ser. No. 849,931, Aug. 8, 1986, Pat. No. 4,710,271.

[51] Int. Cl.[4] ..... D21F 3/00

[52] U.S. Cl. ..... 162/360.1; 100/121; 100/153; 100/93 RP; 102/305; 102/359; 34/116; 34/123

[58] Field of Search ..... 162/305, 358, 360.1, 162/361, 359; 100/121, 151, 152, 153, 154, 93 RP; 34/116, 123

[56] References Cited

U.S. PATENT DOCUMENTS

| | | | |
|---|---|---|---|
| 3,110,612 | 11/1963 | Gottwald et al. | 34/111 |
| 3,319,352 | 5/1967 | Haigh | 34/123 |
| 3,354,035 | 11/1967 | Gottwald et al. | 162/206 |
| 3,799,052 | 3/1974 | Küsters et al. | 100/93 RP |
| 3,891,376 | 6/1975 | Gersbeck et al. | 425/373 |
| 3,938,927 | 2/1976 | Brinkmann et al. | 425/373 |
| 3,973,483 | 8/1976 | Appenzeller | 100/93 RP |
| 4,194,947 | 3/1980 | Huostila et al. | 162/207 |
| 4,324,613 | 4/1982 | Wahren | 162/111 |
| 4,457,683 | 7/1984 | Gerhardt et al. | 425/373 |
| 4,461,095 | 7/1984 | Lehtinen | 34/41 |
| 4,596,633 | 6/1986 | Attwood | 162/206 |
| 4,710,271 | 12/1987 | Miller | 162/360.1 |
| 4,740,305 | 4/1988 | Miller | 210/783 |
| 4,758,310 | 7/1988 | Miller | 162/359 |

FOREIGN PATENT DOCUMENTS

| | | |
|---|---|---|
| WO85/01969 | 5/1985 | PCT Int'l Appl. . |
| 2165340 | 4/1986 | United Kingdom . |

OTHER PUBLICATIONS

Macdonald et al., eds., Paper Making and Paperboard Making, vol. 3, p. 419 (1970).

Anonymous, Hi-I press, Mark III installed at Scott Paper, Mobile, *Pulp and Paper Magazine of Canada*, Nov. 15, 1968, pp. 56 and 57.

*Primary Examiner*—Karen Hastings

*Attorney, Agent, or Firm*—Keith D. Gehr

[57] ABSTRACT

A belt on drum-type press which provides for utilization of a maximum amount of the drum circumference and provides a wide latitude of choice in the relationship between belt tension and press roll nip forces on the drum. In the preferred embodiments the press has a central drum free of axial bending moments and stresses.

17 Claims, 8 Drawing Sheets

BELT AND DRUM-TYPE PRESS WITH SUPPLEMENTAL NIP LOADING MEANS

The present application is a continuation-in-part of my earlier application Ser. No. 094,137, filed Sept. 8, 1987, now U.S. Pat. No. 4,758,310, which was a continuation-in-part of application Ser. No. 849,931, filed Apr. 8, 1986, now U.S. Pat. No. 4,710,271.

BACKGROUND OF THE INVENTION

The present invention relates to an apparatus for compressing a moving web with an endless flexible belt wrapped around a rotatable drum, and particularly to an apparatus and technique of the nature wherein the web is compressed by the belt and roll nips while the web is guided about the heated cylindrical surface of the drum.

Presses are used to consolidate paper and panel products. Examples of this consolidation are the formation of a pulp mat from a pulp slurry, the formation of paper from wood pulp or other fibrous material, or the formation of a panel product from wood particles or flakes. Compressive forces act on and consolidate the material as it passes through the nip formed by a pair of rolls. The greater the compressive force the greater the consolidation.

The compressive forces at the nip perform another function in the formation of paper—the removal of water from the web.

The compressive force acting on a web in the nip between the two rolls is of short duration. The time that the compressive force may act on the web may be extended by the use of a belt press. In a belt press a belt is wrapped around a section of the periphery of a drum and exerts a compressive force on a web passing between the belt and drum. Tension in the belt is translated into a compressive force on the web and drum. Belt presses are used both for paper and for panel products. Gottwald et al., U.S. Pat. Nos. 3,110,612 and 3,354,035 and Haigh, U.S. Pat. No. 3,319,352 are exemplary of belt presses for paper. Gersbeck et al., U.S.Pat No. 3,891,376, Brinkmann et al., 3,938,927 and Gerhardt et al., U.S. Pat. No. 4,457,683 are exemplary of belt presses for panel products.

In my earlier U.S. Pat. No. 4,710,271, I analyzed the forces exerted on a web or mat being pressed by several of these prior art devices. The belt and drum press disclosed in my aforementioned patent represents an improvement in several ways over the earlier known devices. In particular, the prior invention increases the amount of the drum circumference made available for pressing and heating, it creates an increased magnitude of compressive force on the drum produced by belt tension, it provides for an absence of bending moment on the drum and on idler nip rolls, and no significant belt tensioning forces are transmitted to the supporting frame of the machine. The reduced stresses in the drum facilitates the use of novel improved heated drums in the press. Such drums, featuring high thermal conductivity, are disclosed in the earlier noted U.S. Pat. No. 4,710,271. This patent is hereby incorporated by reference.

In the versions of the belt and drum press disclosed in U.S. Pat. No. 4,710,271 and in application Ser. No. 094,137, the roll nip forces on the drum are produced and determined solely by belt tension and belt tensioning forces. Supplemental loading of nip rolls to increase the nip forces of nip rolls on the drum beyond those produced by belt tension is known in the art as in Haigh U.S. Pat. Nos. 3,319,352 Haigh, and Miller U.S. Pat. No. 4,740,305. However, those disclosures are inadequate to describe the particular methods of application of supplemental loading that are required in the present invention to retain the advantages inherent in the present invention.

SUMMARY OF THE INVENTION

The present invention is a belt and drum-type press for pressing, and optionally heating and drying, a moving web. The press utilizes a maximum amount of the drum circumference for pressing, and heating if desired, and provides for improved operation of the press by enabling the flexible selection of nip roll nip forces by selective loading of the nip rolls in manners which will maintain inherent advantages of the press.

The press generally comprises first and second parallel, spaced apart rotatable nip rolls mounted on a frame. The first nip roll serves as a belt entry nip roll and the second as a belt exit nip roll. A central drum lies adjacent to the first and second nip rolls. The axis of rotation of the drum is essentially parallel to that of the nip rolls. There will be at least one idler nip roll having limited freedom of movement generally radial to the drum also located adjacent the drum. All of the nip rolls are located within the body of an endless flexible belt. This is conformed to have an inner generally U-shaped course and an outer generally U-shaped course. The inner and outer courses meet in loops. One loop contains the first nip roll and the other loop contains the second nip roll. The inner course of the belt is wrapped around more than half of the circumference of the drum. The idler nip roll or rolls, as noted before, are also located within the body of the belt. All of the nip rolls make nip contact with the drum through the interposed inner course of the belt and the web to be processed.

Three categories of press configurations are described in the present invention as alternative ways to produce the desired improvement of the process cycle. The first is a press with the outer course of the tension belt supported only by nip rolls and with supplemental nip force means, independent of belt tension and belt tensioning means, being used on selected nip rolls in a manner to keep the drum free of axial bending moment. The second category is a press utilizing a guide roll, not nipping with the drum, to support the outer run of the belt clear of the drum and idler nip rolls and having force means independent of belt tension to create nip forces in the nip rolls, in a manner to maintain, or permit the maintenance, of the drum to be free of bending moment. The third category is a combination of the above, wherein nip forces of the individual nip rolls may be produced by any of: belt tension only, both belt tension and other force means, or by other force means only.

In all cases, the application of supplemental force means to nip roll journals or support shaft will create bending moment in that nip roll which may require special known construction to maintain the desired non-tapered cylindrical shape. In the case of nip rolls having nip forces created by belt tension, unequal angles between the radial line from the drum to the roll and the approach and departure paths of the belt to and from the roll will also produce bending moment.

All the configurations disclosed utilize the feature of the drum moving radially to the first and second nip rolls or the first and second nip rolls moving to nip with the drum. This feature is necessary to utilize a maximum amount of the drum circumference and to enable the drum to be free of axial bending moment. Further, in order to maintain the drum free of axial bending moment, or maintain the ability to achieve that, the net resultant force on the drum resulting from the combined forces of all the idler nip rolls, must pass between the centers of rotation of the first and second nip rolls.

All of the three categories described above are generally equal in ability to achieve the desired improvement in process cycle. The user will select one category in preference to another based on mechanical component differences, rather than process effect.

The press also includes a driving system for rotating the belt through its endless path around the nip rolls and drum so that it may compress a web or mat interposed between the belt and drum.

In the preferred version of the press the drum will be floating to the extent that it has freedom to move radially toward or away from the first and second nip rolls, as urged by the belt and idler nip rolls. It is equally possible for the drum to be mounted in fixed position on the frame with all of the nip rolls having freedom of movement to and from the drum. In that case, separate loading means may be used to supplement the nip forces of the first and second nip rolls created by the tension belt. Where the drum is shaft mounted in fixed position on the frame, it is possible to exert external nip forces on the first and second nip rolls, those denoting the belt entry and exit locations, in addition to the force exerted on the idler nip roll. In this configuration it is possible that axial bending moment may be imposed upon the central drum if the nip forces are not properly balanced. However, if balanced forces are desired they can be readily achieved through the use of load cells incorporated into the drum shaft supports to show radial forces acting on the drum. Outputs of individual load cells can be analyzed to show the net resultant radial force. This can then be balanced to zero by appropriate adjustments of the loading mechanisms acting on the nip rolls.

It is an object of the present invention to provide a belt and drum-type press using a process cycle comprising the pressure of a tension belt on a web on a drum with multiple roll nip forces superimposed on that belt pressure, in which the relative magnitude of the uniform belt pressure on the drum and the individual nip forces can be selectively determined, independent of belt tension, given that the uniform belt pressure is always proportional to belt tension.

It is another object to provide a press of the type described in which radial forces on the drum are intrinsically balanced to leave the drum free of axial bending moment, or the construction permits achieving that condition selectively with the use of force indicators on the drum.

It is yet another object to provide a press which uses a maximum amount of the drum circumference for pressing and heating.

It is a further object to provide a press of the type described having greater versatility in construction and operating than those which have been previously known.

These and many other objects will become readily apparent to those skilled in the art upon reading the following detailed description taken in conjunction with the drawings.

DETAILED DESCRIPTION OF THE PREFERRED EMBODIMENTS

In the earlier versions of my press described in U.S. Pat. No. 4,710,271 and in application Ser. No. 094,137, all nip forces are directly related to and are produced by belt tension. The present invention differs in that the nip rolls may be independently loaded to the desired nip forces without dependence on belt tension. In all embodiments of the invention it is most desirable that the net resultant force of all idler nip rolls on the drum passes between the first and second nip rolls. Where the drum is movable with respect to these two rolls that feature is essential. In all versions the feature is necessary to achieve balanced forces on the drum to eliminate bending moment.

Figure 1:
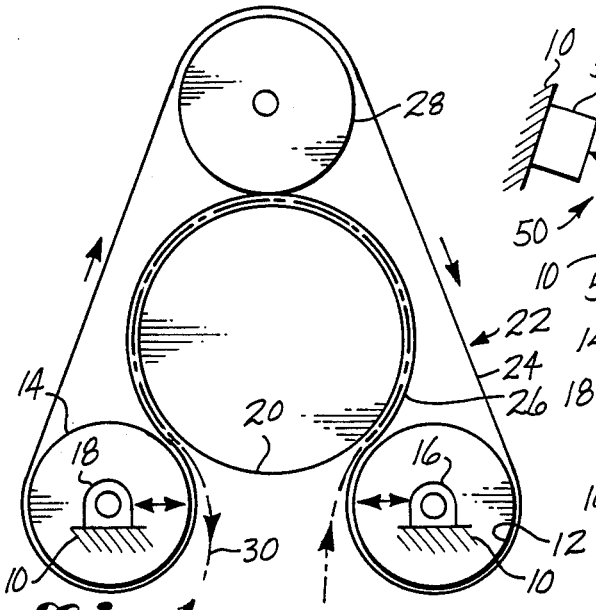
FIG. 1 shows a diagrammatic representation of my earlier drum and belt press as shown in my earlier U.S. Pat. No. 4,701,271.

Reference should now be made to the figures. FIG. 1 shows a simplified side elevation of a typical belt and drum-type press as shown in U.S. Pat. No. 4,710,271. It consists of a frame 10 on which are mounted a first or belt entry nip roll 12 and second or belt exit nip roll 14. These nip rolls have shafts which are journalled in bearings 16, 18. The bearings are mounted on frame 10 so that they can travel toward or away from each other in order to control belt tension. Drum 20 and all of the nip rolls are contained within an endless belt 22. This belt has an outer generally U-shaped course 24 and an inner generally U-shaped course 26. Drum 20 is wrapped by the inner course and an idler nip roll 28 is contained within the body of the belt. A drive means, not shown, moves the belt in the direction indicated so that a web or mat 30 is pressed between the belt and drum. It might be noted that in this configuration the drum is floating relative to the first and second nip rolls 12 and 14 and has freedom of movement toward or away from these rolls as belt tension is increased or relaxed. Idler nip roll 28 also must have freedom of movement toward or away from the drum.

Figure 2:
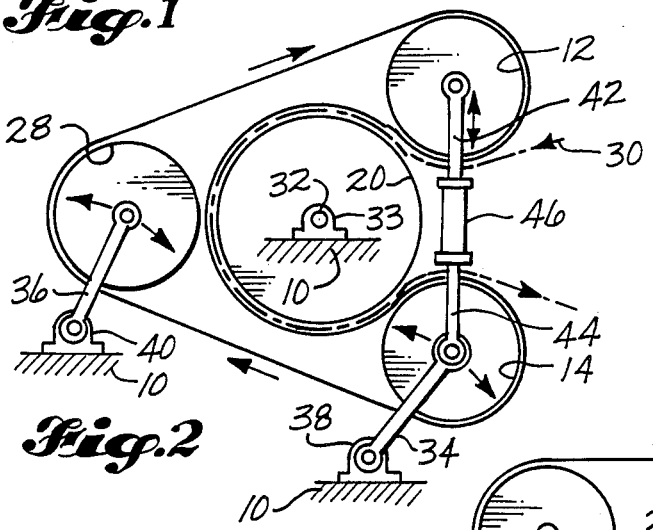
FIG. 2 is a diagram of an alternate version of my earlier drum and belt press.

FIG. 2 is an alternative version of the press which is described in my application Ser. No. 094,137. It functions in the same manner as the press of FIG. 1. However, here the drum 20 is mounted on a shaft 32 fixed by a bearing 33 to a frame 10. First and second nip rolls 12 and 14 and the idler nip roll 28 must be able to adjust toward or away from the drum as belt tension is varied. To accommodate this necessity second nip roll 14 is mounted on a movable strut or radius arm 34 and idler nip roll 28 is mounted on a similar strut 36. These are pivotally mounted to the frame 10 in bearings indicated respectively at 38 and 40. The press is tensioned by tensioning rods 42, 44 connected respectively to the shafts of entry and exit nip rolls 12 and 14, acting through a tensioning device 46. The tensioning device would normally be a hydraulic cylinder although other mechanical means could be employed as well.

Figure 3:
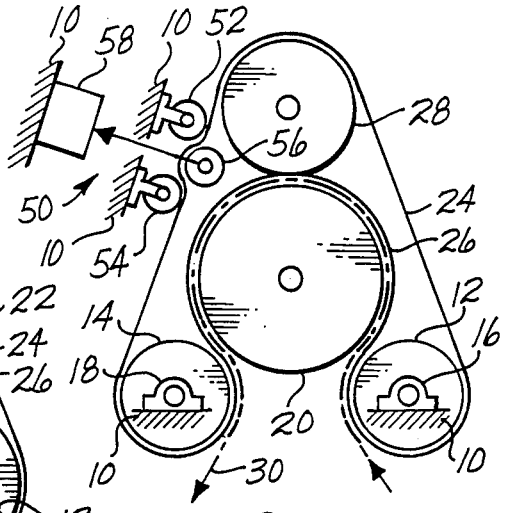
FIGS. 3 and 4 are diagrams showing alternative means of belt tensioning.

A somewhat different version of the press is shown in FIG. 3. This press is also disclosed in my application Ser. No. 094,137. The press shown here has many similarities to that of FIG. 1. However, here bearings 16 and 18 mounting first and second nip rolls 12 and 14 are in fixed position on frame 10. As such they are not able to provide tensioning as is the case in the embodiment of FIG. 1. In the present version, tensioning is accomplished by a mechanism generally shown in 50. This includes frame mounted rolls 52 and 54 which are external to the body of the belt and roll 56 which is within the body of the belt and adjacent to the outer course. Roll 56 acts in conjunction with a tensioning device 58, which also is preferably a hydraulic cylinder. The advantages of the earlier versions are maintained in the present embodiment; i.e., no significant axial bending moments are created on the drum.

Figure 4:
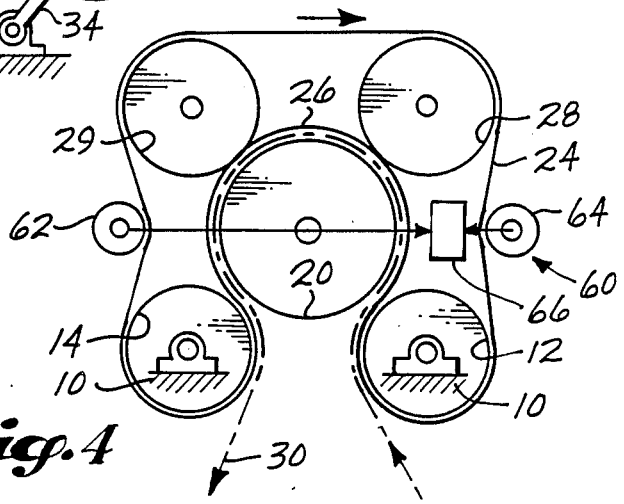

A further tensioning arrangement is shown in FIG. 4. This example is also drawn from my application Ser. No. 094,137. This configuration is similar to that that of FIG. 3 in many respects; e.g., the entry/exit nip rolls 12, 14 are in fixed position on frame 10. In the current embodiment an additional idler nip roll 29 has been added. Tensioning is accomplished by a mechanism which consists of rolls 62 and 64, which are external to the body of the belt. These are tied through appropriate linkages to a tensioning device 66. As is the case in all the previous examples, the tensioning device is preferably one or more hydraulic cylinders.

Figure 5:
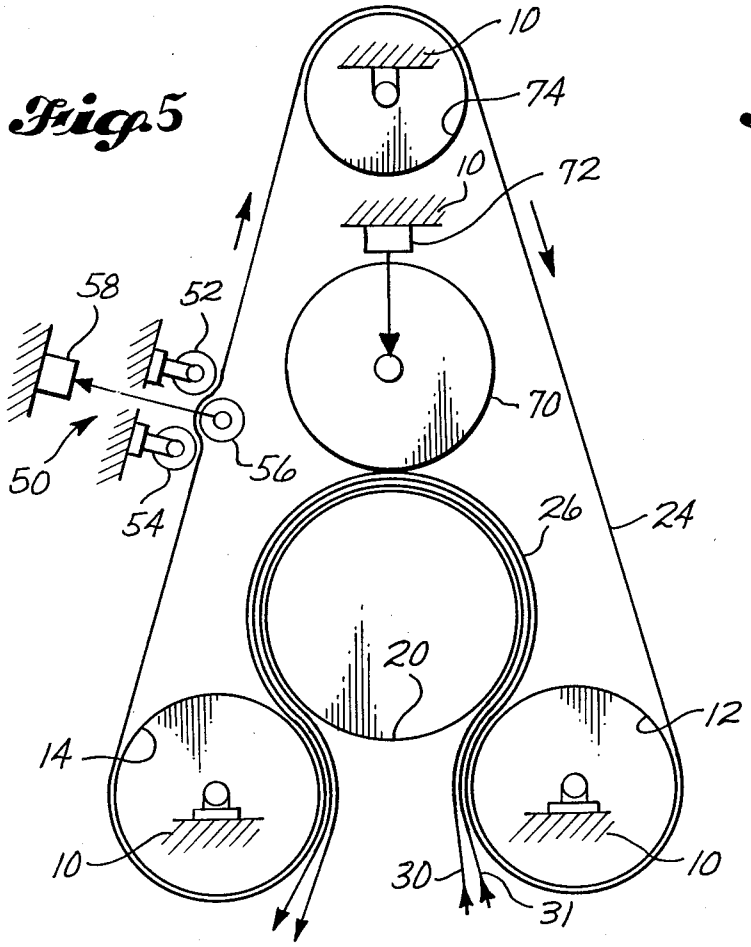

FIG. 5 shows one version of the belt and drum-type press of the present invention. It will be noted that this is similar in many respects to the press of FIG. 3. Belt entry and exit nip rolls 12 and 14 are in fixed position on frame 10 and belt tensioning mechanism 50 is identical to that shown in FIG. 3. However, the outer course of the belt has been extended and no longer wraps around the idler nip roll, here designated at 70. Instead it is returned around a guide roll 74 held in fixed position on frame 10. Nip roll 70 is attached to a nip roll loading device 72 which acts between frame 10 and the nip roll. Thus, nip pressure exerted by idler nip roll 70 is entirely independent of belt tension. Forces exerted on the drum by idler nip roll 70 will be resisted by nip rolls 12 and 14 and their nip forces will consequently be increased over those which are imposed solely by belt tension. Using this configuration, bending forces will be imposed upon all of the nip rolls and guide roll. Depending upon the forces involved, it may be necessary to use well known deflection resisting construction in all of the rolls contacting the drum and belt. However, the drum will inherently be free of axial bending moments if the cylindrical shape of all rolls is maintained.

Figure 6:
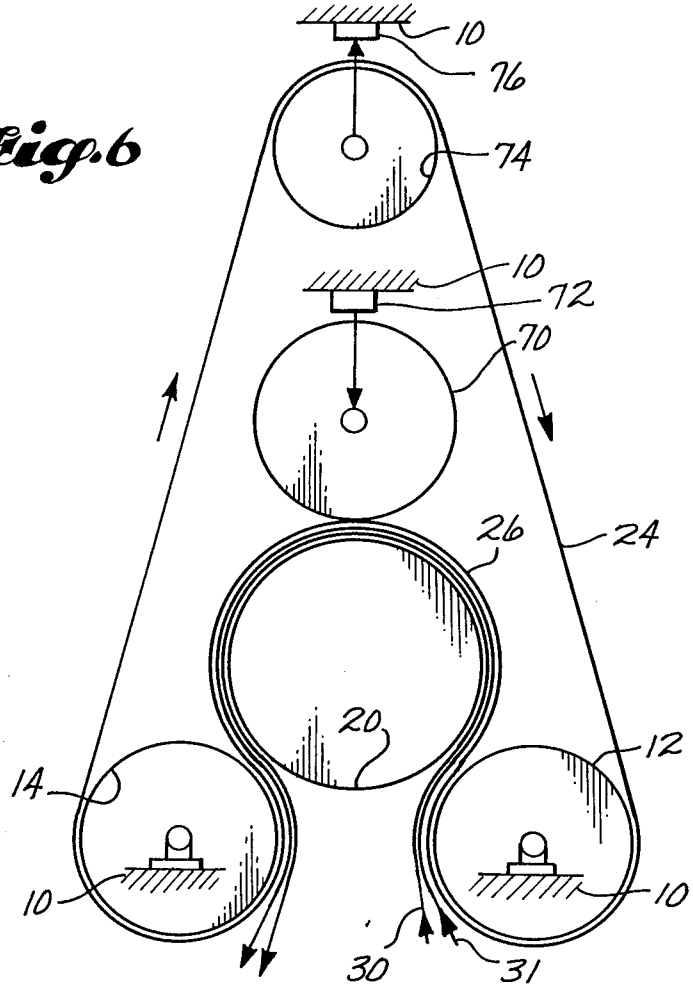
FIGS. 5 to 11 are diagrams showing alternative new versions of a drum and belt press in which there is some nip loading independent of belt tension.

The press shown in FIG. 6 is similar to that in FIG. 5. However, here construction has been simplified by making belt guide roll 74 also serve as a belt tensioning roll. Roll 74 is tied to a tensioning device 76 supported from frame 10. Other than this the construction and operation of the press is identical to that shown in FIG. 5, with the exception that tensioning mechanism 50 is no longer required.

In FIGS. 5 and 6, and in all of the subsequent figures, the web or mat 30 being pressed is carried under an optional felt 31. The felt is normally used to pick up water or other fluid expressed from mat 30 under the forces imposed by the press.

Figure 8:
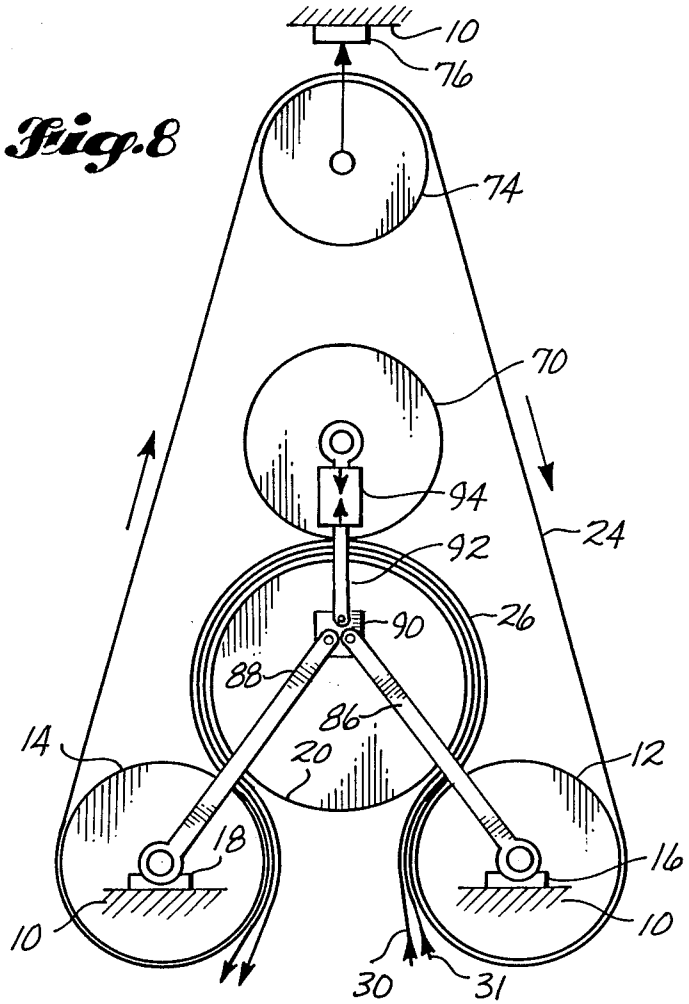
Figure 7:
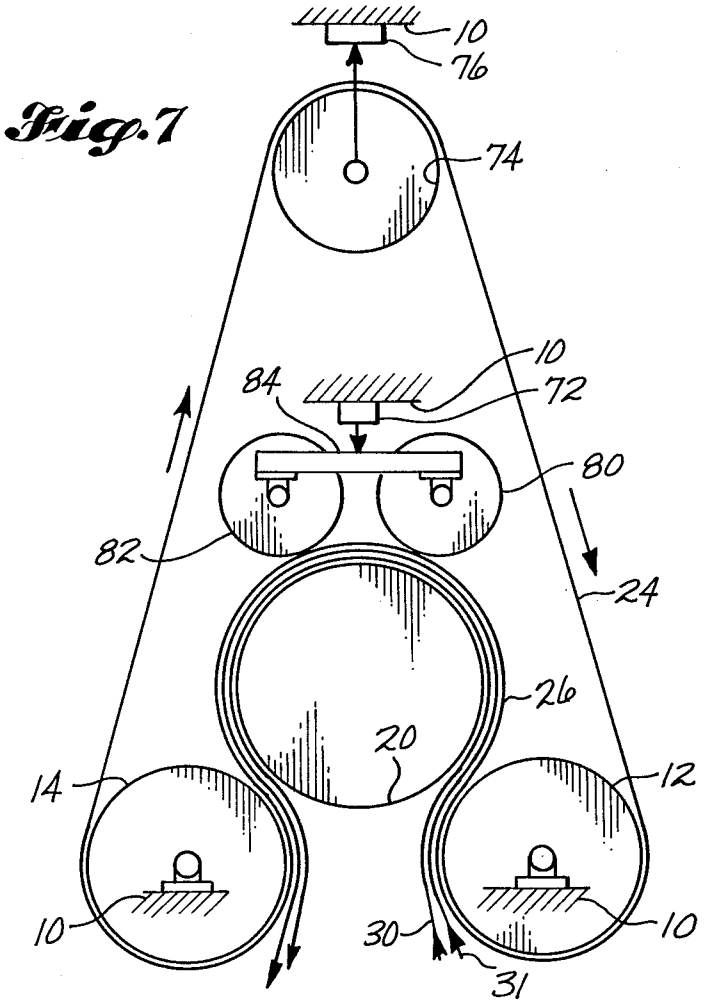

The version of the press shown in FIG. 7 is nearly identical to that of FIG. 6. The one difference is that a pair of idler nip rolls 80, 82 are used in place of the single idler nip roll 70. These are mounted on a spacer bar or sub frame assembly 84 which, in turn, is acted on by the nip roll loading device 72. It is noted here that all of the rolls must be sized and positioned so that the inner course of the belt does not rub against the outer course of the belt. FIG. 8 shows the present invention with an optional idler nip roll loading configuration. Idler nip roll 70 has its loading device 94 pivotally connected to a floating block 90 which in turn is pivotally linked to the first and second nip rolls 12, 14 by struts 86, 88. Struts 86, 88 are supported from the shafts of the belt entry nip roll 12 and belt exit nip roll 14, thus simplifying the support structure of the press.

Figure 9:
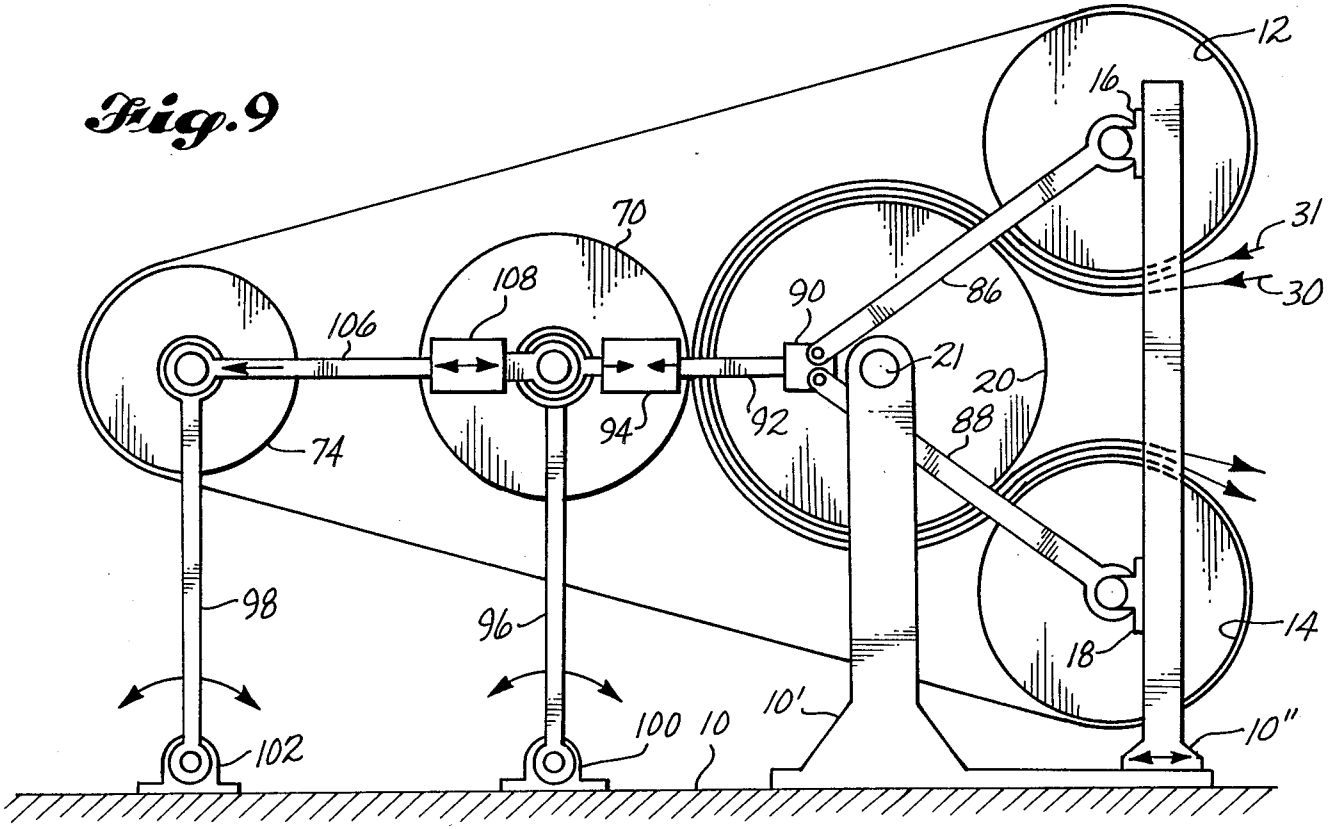

FIG. 9 shows a configuration of the present invention in which drum 20 is supported on a shaft 21 by machine frame element 10'. The belt entry and exit nip rolls 12, 14 are mounted on a subframe element 10'' which is slidably mounted on machine mainframe element 10. The linkage between the first and second nip rolls 12, 14 with idler nip roll is the same as was shown in FIG. 8. Here, however, idler nip roll 70 is supported on a movable strut or radius arm 96 pivotally mounted to frame 10 at bearing 100. In similar fashion, belt guide roll 74 is mounted to frame 10 by movable strut 98 which is pivotally mounted to the main frame element 10 at bearing 102. Tensioning is accomplished by a tensioning device 108 acting against guide roll 74 through a linkage 106. All forces due to belt tension imposed on the drum are balanced, as are all other forces imposed, thus leaving the drum free of axial bending moments and stresses.

Figure 10:
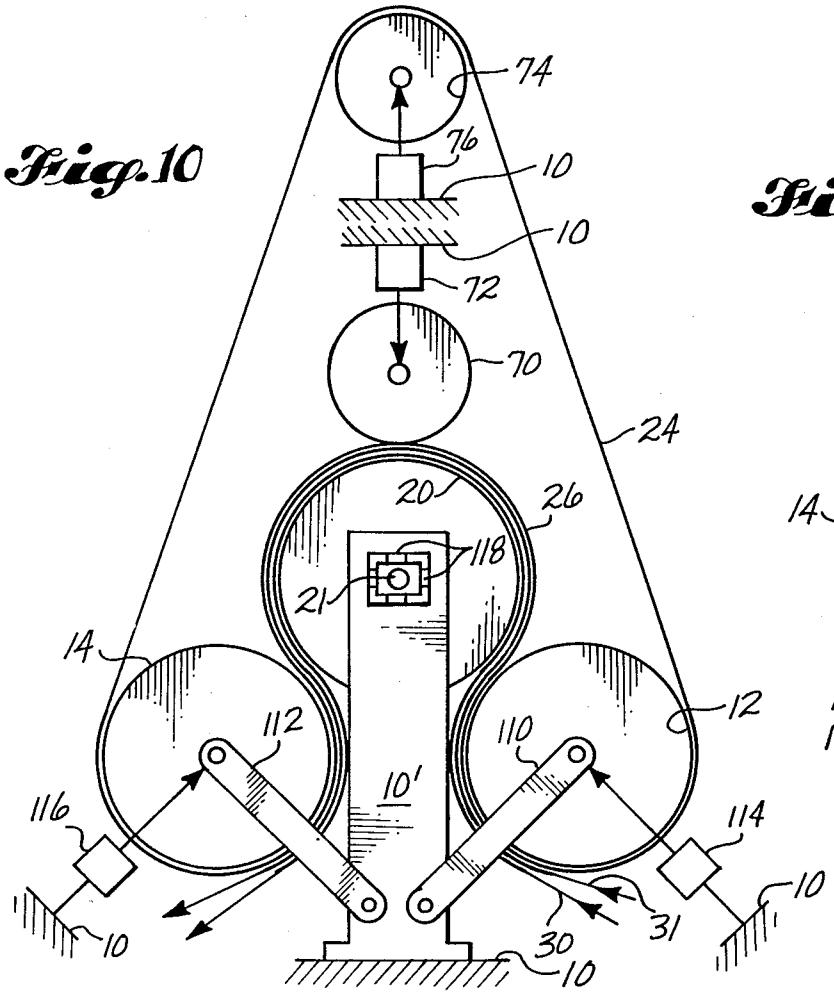

FIG. 10 is another embodiment of the present invention in which drum 20 is supported by shaft 21 on subframe element 10'. The first or belt entry nip roll 12 and the second or belt exit nip roll 14 are mounted on struts 110, 112 respectively which are pivotally mounted at their opposite ends to subframe member 10'. Nip roll loading devices 114, 116 act respectively against the first and second nip rolls 12, 14. In similar fashion nip roll loading element 72 imposes the required load on idler nip roll 70. With this construction it is quite possible that nip forces on the drum could be unbalanced, thus imposing bending moments. Nip forces may be balanced by using load sensing elements 118 to indicate vertical and lateral drum loading. The forces indicated by each of these load cells may be readily analyzed electronically to show the net resultant radial force acting on the central drum. Nip roll loading devices 72, 114, 116 can then be adjusted to minimize to eliminate any bending moments imposed upon the drum by reducing the net resultant radial force to zero. It is noted again that to meet this condition the net resultant of all nip forces of idler nip rolls upon the drum must pass between first and second nip rolls 12, 14.

Figure 11:
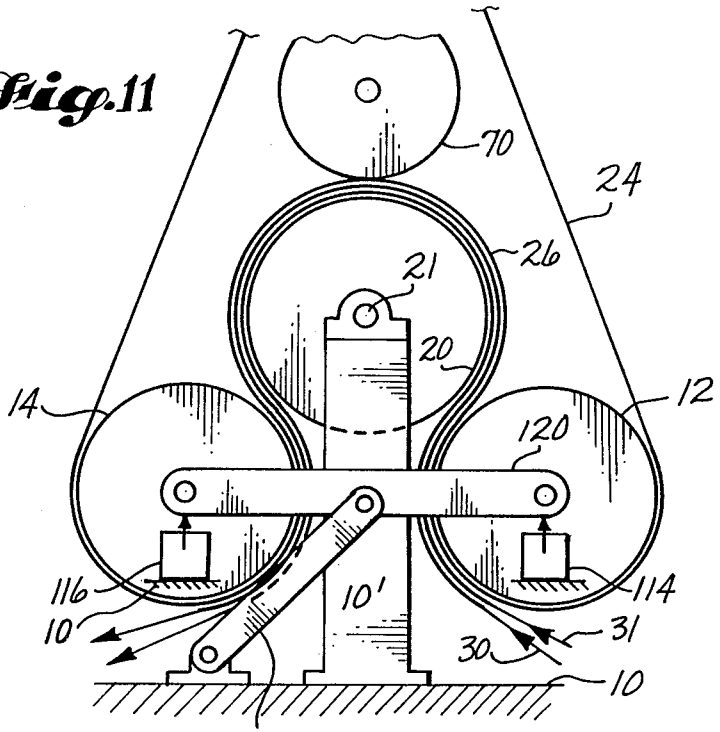

FIG. 11 illustrates another alternative configuration for supporting the first and second nip rolls 12, 14 for an embodiment in which the central drum 20 is in a fixed position, as is shown here by being supported on shaft 21 mounted on machine subframe element 10'. First and second nip rolls 12, 14 are mounted on a spacer bar 120 which is positioned by strut or radius arm 122 so that the nip roll loading devices 114, 116 can cause these rolls to nip against the drum. Many other different configurations can serve the same purpose by meeting the requirement that the nip rolls must be able to move generally radially to the drum in order to nip properly.

Figure 12:
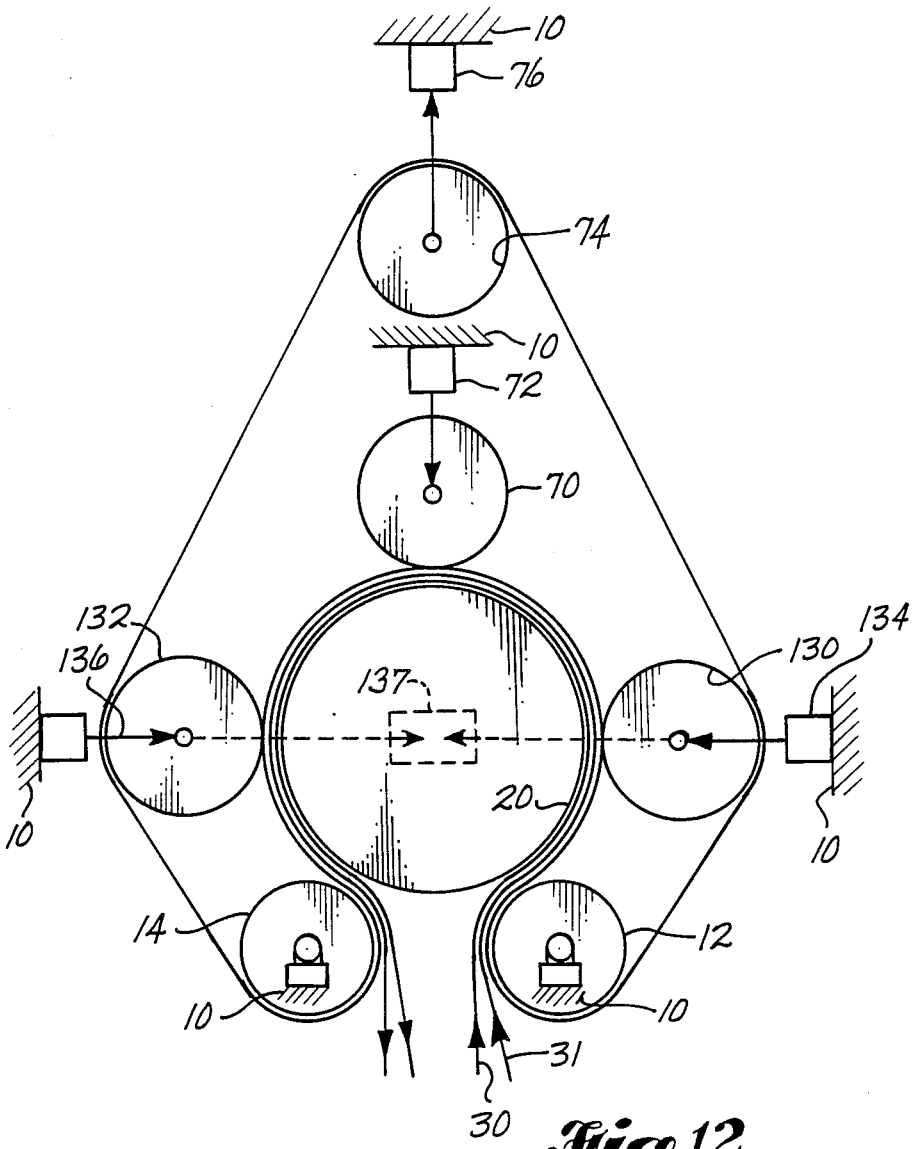
FIG. 12 is an alternative configuration of the invention illustrating a combination of mode of nip loading.

FIG. 12 has all of the basic features of the press illustrated in FIG. 6, with the addition of idler nip rolls 130, 132 on either side of drum 20. These additional nip rolls are controlled by loading devices 134, 136 respectively in addition to belt tension. As long as nip rolls 132 and 134 are opposed across a diameter of the press, as shown in the illustration, their contribution to the net resultant force on the drum imposed by any other nip rolls, such as nip roll 70, will be zero. Stated differently, the loading imposed by nip rolls 132 and 134 makes no contribution to the loading imposed on first and second nip rolls 12 and 14 by idler nip roll 70. Alternatively, a single loading device 137, shown in dashed lines on the drawing, may be used in place of loading devices 134, 136. The use of the single loading device 137 has the advantage that forces imposed by nip rolls 130, 132 are always balanced.

Figure 13:
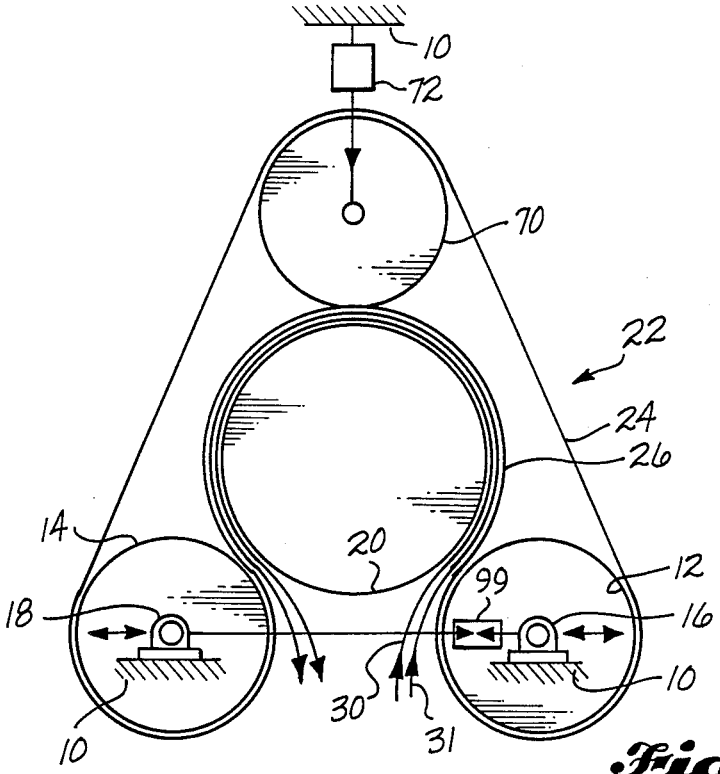
FIG. 13 is an example of my earlier drum and belt press of FIG. 1 with supplemental nip loading added in a known way.

FIG. 13 shows the press of U.S. Pat. No. 4,710,271 with supplemental nip loading added in a known way. The tension means 99 acting on the tensioning rolls 12, 14 must be reset beyond the belt tension force setting to account for the increased nip forces on tensioning rolls 12 and 14 introduced by the supplemental nip loading.

Figure 14:
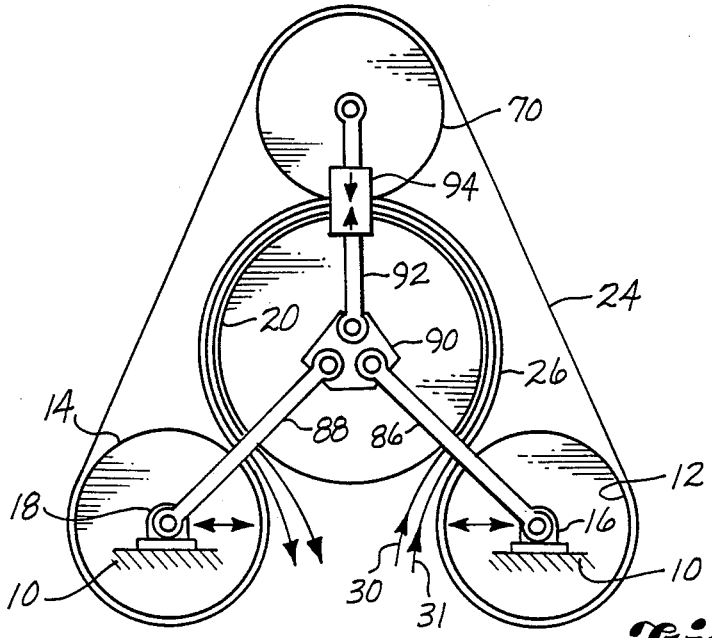
FIGS. 14 to 16 are alternative configurations of the present invention.

FIG. 14 shows an alternative configuration of the present invention in which supplemental nip loading is added to the press of U.S. Pat. No. 4,710,271, illustrated in FIG. 1, in a way which does not interfere with the belt tensioning means. That is, the forces applied to tensioning nip rolls 12 and 14 by support bars 86 and 88 are radial to the drum, therefore there is no lateral or circumferential force components on rolls 12 and 14 from the supplemental nip loading.

Figure 15:
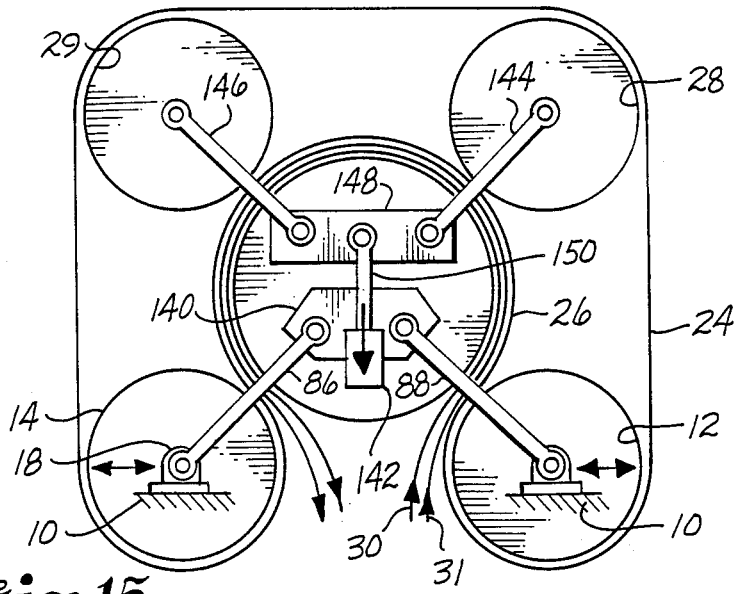

FIG. 15 is similar to the press of FIG. 14 except that it illustrates the present invention using two idler nip rolls 28 and 29. The floating block has been modified, as shown at 140, to include a loading means 142. Struts 144 and 146 pivotally connect the shafts of idler nip rolls 28, 29 respectively to a second floating block 148. Rod 150 ties floating block 148 to loading means 142. The support bar system has thus been modified to provide nip forces for the two nip rolls 28 and 29.

Figure 16:
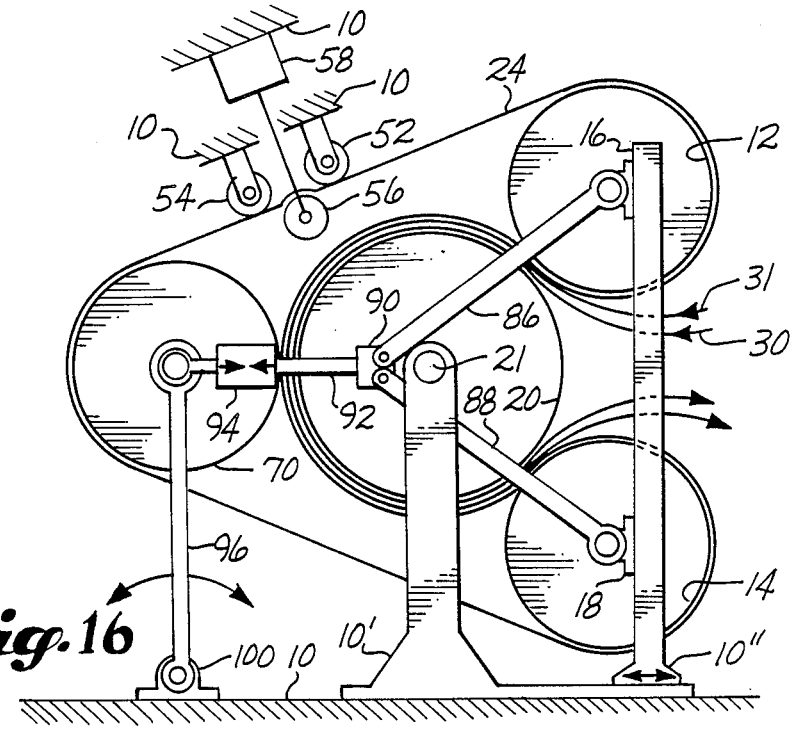

FIG. 16 illustrates the press similar to the one described in application Ser. No. 094,137 with supplemental nip roll loading added according to the teachings of the present invention. Since bearings 16 and 18 on the shaft of belt entry and exit nip rolls 12 and 14 are in fixed position on movable subframe 10", the support bars 86 and 88 may be pivotally attached directly to subframe 10" if desired.

Having thus described the best mode or modes known to the inventor for practicing the present invention, it will be evident to those skilled in the art that many variations can be made without departing from the spirit of the invention. As one example, other features can be designed into the supports to absorb belt tension forces on the nip rolls into the frame or otherwise letting those forces be transmitted into roll nip forces with the drum. With such possible variations in mind, the inventor regards his invention as being limited only by the appended claims.

I claim:

1. A drum and belt-type press for compressing a moving web or mat which comprises:

(a) a supporting frame;

(b) first and second spaced apart rotatable nip rolls mounted on the frame, said rolls having parallel axes of rotation, the first roll positioned as a belt entry nip roll and the second roll positioned as a belt exit nip roll;

(c) a central drum adjacent the first and second nip rolls, the drum having an axis of rotation essentially parallel to said nip rolls;

(d) at least one idler nip roll having limited freedom of movement generally radial to the drum also being located adjacent the drum;

(e) an endless flexible belt having an inner generally U-shaped course and an outer generally U-shaped course, the inner and outer courses meeting in loops, one loop containing the first nip roll and the other loop containing the second nip roll, the inner course of the belt being wrapped around more than one half of the circumference of the drum, said first and second nip rolls being located within the body of the belt, said idler nip roll or rolls also being located within the body of the belt, between the first and second nip rolls, all of the nip rolls making nip contact with the drum through the interposed inner course of the belt (f) at least one belt guide roll located within the body of the belt to support the outer course of the belt, said guide roll or rolls not making nip contact with the drum, the location and sizes of the guide roll or rolls and the nip rolls acting to maintain clearance between the outer course of the belt and the inner course of the belt;

(g) tensioning means to control belt tension;

(h) supplemental loading means for one or more of said idler nip roll or rolls, to create a desired nip force for said idler nip roll or rolls acting upon the drum, independent of belt tension, the location of all said idler nip rolls and the nature of the forces they exert on the drum being such and the press being constructed and arranged such that the net resultant force of all idler nip roll forces upon the drum is directed between the centers of rotation of the first and second nip rolls; and (i) driving means for rotating the belt through its endless path so as to compress a web or mat interposed between the moving belt and drum, the drum being structured and arranged to have freedom to move radially toward or away from the first and second nip rolls so that the drum presses upon the first and second nip rolls with a force controlled by belt tension and the net resultant force of the idler nip roll forces.

2. The press of claim 1 in which said at least one idler nip roll is in contact only with the inner course of the belt and clearance is maintained between the belt outer course and said idler nip roll or rolls.

3. The press of claim 1 in which the belt tensioning means includes at least one moveable roll acting upon the belt outer course, said roll being connected to a tensioning device supported by the frame to control belt tension, said moveable tensioning roll or rolls not being in nip contact with the drum.

4. The press of claim 3 in which said at least one belt guide roll also serves as a belt tensioning roll.

5. The press of claim 1 in which said at least one idler nip roll comprises at least two idler nip rolls which are mounted on a common subframe which is acted on by the idler roll supplemental loading means.

6. The press of claim 1 in which the first and second nip rolls are shaft mounted and the idler nip roll loading means is supported from the shafts of the first and second nip rolls.

7. The press of claim 1 in which at least one idler nip roll is contacted by the outer course of the endless belt causing a nip force of that idler nip roll or rolls with the drum resulting from belt tension.

8. A drum and belt-type press for compressing a moving web or mat which comprises:

(a) a supporting frame for a drum, belt tensioning rolls, and belt tensioning means;

(b) a pair of spaced apart first and second shaft mounted cylindrical belt tensioning rolls having essentially parallel axes of rotation;

(c) a central drum adjacent said tensioning rolls, said drum having an axis of rotation essentially parallel to the axis of rotation of the rolls;

(d) an endless flexible belt having an inner generally U-shaped course and an outer generally U-shaped course, the inner and outer courses meeting in loops which wrap around the tensioning rolls, the tensioning rolls each being contained within the body of the belt and the drum being outside the body of the belt, the inner course of the belt being wrapped around more than half the circumference of the central drum, the tensioning rolls and drum being sized so that the inner and outer courses of the belt are spaced apart, each tensioning roll and any other rolls within the belt making nip contact with the drum through the interposed belt so that the total compressive forces of the belt and nips on the central drum are balanced and the summation of forces about the drum axis is essentially zero;

(e) drive means for moving the belt through its endless path, so that a web or mat may be compressed by interposing it between the moving belt and drum;

(f) tensioning means acting on the tensioning rolls to translate them relatively toward or away from each other to control belt tension while maintaining nip contact;

(g) the tensioning rolls being mounted on the supporting frame, the drum being free floating with respect to the tensioning rolls for relative radial movement in response to tensioning adjustments, and the press is structured to maintain nip contacts without transmitting significant belt tensioning forces to the supporting frame or significant axial bending moment to the drum;

(h) at least one shaft mounted idler nip roll enclosed within the flexible belt body between the first and second tensioning rolls, the idler nip roll or rolls being radially movable by the outer course of the belt and forming nips with the central drum through the interposing belt when said belt is in tension, the belt, idler nip rolls, and tensioning rolls all being in a balanced force relationship with the drum; and (i) one or more of said idler nip roll or rolls having supplemental force means acting on its support shaft to create a nip force of the idler nip roll with the drum, independent of the nip force created by the tension of the endless belt, the press is structured and arranged so that the net resultant force of all idler nip forces from all sources passes between the centers of rotation of the first and second tensioning rolls, pivotally connected support bars providing support from the first and second belt tensioning roll shafts to the supplemental force means, said support bars being aligned on drum radial lines through said first and second tensioning roll centers of rotation, the orientation of said support bars serving to avoid any material impact of supplemental nip roll loading on said belt tensioning means.

9. A drum and belt-type press for compressing a moving web or mat which comprises:

(a) a supporting frame for a pair of nip rolls and a belt tensioning means;

(b) first and second fixed spaced apart shaft mounted rotatable nip rolls mounted on the frame to form an assembly, said rolls having parallel axes of rotation;

(c) a central drum adjacent the nip rolls, the drum having an axis of rotation essentially parallel to the nip rolls;

(d) at least one shaft mounted idler roll having limited freedom of movement generally radial to the drum also located adjacent the drum;

(e) an endless flexible belt having an inner generally U-shaped course and outer generally U-shaped course, the inner and outer courses meeting in loops, one loop containing the first fixed nip roll and the other loop containing the second fixed nip roll, the fixed nip rolls and said movable idler nip roll or rolls being located within the body of the belt, the inner course of the belt being wrapped around more than one half of the circumference of the drum so that all the nip rolls make nip contact with the drum through the interposed belt, the drum, fixed nip rolls and idler nip rolls being sized to hold the inner and outer courses of the belt in spaced apart relationship;

(f) at least one moveable belt tensioning roll mounted to act against the belt to control belt tension, said tensioning roll or rolls not making nip contact with the drum;

(g) tension control means to adjust the tensioning rolls;

(h) means for rotating the belt through its endless path to compress a web or mat interposed between the moving belt and drum, the drum being free to move radially to the fixed nip rolls or the nip roll and frame assembly being free to move to the drum so that the nip rolls act through the belt against the drum with a force controlled by belt tension; and (i) supplemental force means acting on the support shaft of one or more of the idler nip rolls to create a nip force of the idler nip roll or rolls with the drum, independent of the nip force created by the endless tension belt, pivotally connected support bars connected to the supporting frame for the first and second fixed spaced apart nip rolls to provide support for the supplemental force means, the press being structured and arranged so that the next resultant force on the drum resulting from all idler nip roll nip forces passes between the centers of rotation of the first and second fixed spaced apart nip rolls.

10. A drum and belt-type press for compressing a moving web or mat which comprises:

(a) a supporting frame;

(b) first and second spaced apart rotatable nip rolls movably mounted on the frame, said rolls having parallel axes of rotation, the first roll positioned as a belt entry nip roll and the second roll positioned as a belt exit nip roll;

(c) a central drum adjacent the first and second nip rolls, said drum being shaft mounted in the frame in a fixed location and having an axis of rotation essentially parallel to said nip rolls and located so that the movably mounted first and second nip rolls may freely nip with the central drum;

(d) at least one idler nip roll having limited freedom of movement generally radial to the drum also being located adjacent the drum;

(e) an endless flexible belt having an inner generally U-shaped course and an outer generally U-shaped course, the inner and outer courses meeting in loops, one loop containing the first nip roll and the other loop containing the second nip roll, the inner course of the belt being wrapped around more than one half of the circumference of the drum, said first and second nip rolls being located within the body of the belt, said idler nip roll or rolls also being located within the body of the belt between the first and second nip rolls, all of the nip rolls making nip contact with the drum through the interposed inner course of the belt;

(f) at least one belt guide roll being located within the body of the belt to support the outer course of the belt, said guide roll or rolls not making nip contact with the drum, the location and sizes of the guide roll or rolls and the nip rolls acting to maintain clearance between the outer course of the belt and the inner course of the belt;

(g) tensioning means to control belt tension;

(h) supplemental loading means for one or more of said idler nip roll or rolls, to create a desired nip force for said idler nip roll or rolls acting upon the drum, independent of belt tension, the location of all said idler nip rolls and the nature of the forces they exert on the drum being such and the press being constructed and arranged such that the net resultant force of all idler nip roll forces upon the drum is directed between the centers of rotation of the first and second idler nip rolls, said first and second nip rolls being shaft mounted and the loading means of at least one of said idler nip roll or rolls being supported from the shafts of said first and second nip rolls; and (i) driving means for rotating the belt through its endless path so as to compress a web or mat interposed between the moving belt and drum.

11. The press of claim 10 in which the belt tensioning means includes at least one moveable roll located within the body of the belt and acting upon the belt outer course, said roll being connected to a tensioning device supported by the frame to control belt tension, said moveable tensioning roll or rolls not being in nip contact with the drum.

12. The press of claim 11 in which said at least one belt guide roll also serves as a belt tensioning roll.

13. The press of claim 10 in which the idler nip roll or rolls and belt guide roll or rolls are shaft mounted and are attached to the frame through moveable struts pivotally attached to the frame and the belt is tensioned by loading means acting between the shafts of the idler nip roll or rolls and belt guide roll or rolls.

14. The press of claim 10 in which the central drum is shaft supported on the frame and the first and second nip rolls are movably supported from the frame, and further including additional nip roll loading means acting between the frame and said first and second nip rolls.

15. The press of claim 14 which further includes load indicating means associated with the central drum to indicate radial forces acting on the drum, said radial forces being controllable by the first and second nip roll loading means, belt tensioning means, and idler nip roll loading means.

16. The press of claim 15 in which the load indicating means comprises load cells incorporated into supports of the drum shaft.

17. The press of claim 15 in which the load indicating means further includes force analyzing means to show the net resultant radial force acting on the central drum.

* * * * *